United States Patent [19]

Brucken

[11] 4,297,085

[45] Oct. 27, 1981

[54] GUIDE MECHANISM FOR COMPRESSOR SOCKET PLATE

[75] Inventor: Byron L. Brucken, Miamisburg, Ohio

[73] Assignee: General Motors Corporation, Detroit, Mich.

[21] Appl. No.: 89,996

[22] Filed: Oct. 31, 1979

[51] Int. Cl.[3] ..... F04B 1/28

[52] U.S. Cl. ..... 417/222; 74/60; 417/269

[58] Field of Search ..... 74/60; 417/222, 269, 417/270

[56] References Cited

U.S. PATENT DOCUMENTS

| | | | |
|---|---|---|---|
| 2,571,312 | 10/1951 | Trevaskis | 417/269 |
| 3,198,022 | 8/1965 | De Waern | 74/60 |
| 4,037,993 | 7/1977 | Roberts | 417/269 |
| 4,105,370 | 8/1978 | Brucken | 417/222 |
| 4,175,915 | 11/1979 | Black | 417/222 |

*Primary Examiner*—William L. Freeh

*Attorney, Agent, or Firm*—R. L. Phillips

[57] ABSTRACT

A variable output axial compressor having an improved socket plate guide mechanism. A spherical bearing body is reciprocally supported on a guide rod which extends axially through the compressor socket plate cavity. A pair of guide shoes, radially movable in complementary socket plate guides, receive and relatively slidably retain the bearing body therebetween obviating rotational movement of the socket plate. The guide rod includes a longitudinal, fluid flow passage for carrying control fluid through the socket plate chamber from the rear head to an expansible chamber at the front cover.

3 Claims, 6 Drawing Figures

GUIDE MECHANISM FOR COMPRESSOR SOCKET PLATE

This invention relates to axial compressors and more particularly to a variable displacement refrigerant compressor having an improved socket plate guide mechanism.

The U.S. Pat. No. 4,061,443 issued Dec. 6, 1977 to Black et al, the U.S. Pat. No. 4,105,370 issued Aug. 8, 1978 to Byron L. Brucken et al and the U.S. Pat. No. 4,108,577 issued Aug. 22, 1978 to Brucken et al, each assigned to the assignee of the present patent application, disclose related variable displacement socket plate axial compressors. The present invention concerns an improved socket plate guide arrangement and fluid flow circuit for variable displacement compressors of the type set forth in these patents providing a compact, reduced weight compressor assembly that also achieves a simplification of manufacturing and assembly operations.

It is accordingly one of the objects of the present invention to provide an axial compressor having an improved socket plate guide mechanism wherein a guide rod extends through the compressor socket plate assembly cavity with the rod reciprocally supporting a bearing body thereon. The bearing body includes a spherical portion such that a pair of guide shoe members, radially movable on the socket plate, are designed for receiving and relatively slidably retaining the bearing body spherical portion therebetween while obviating rotational movement of the socket plate.

A further object of the present invention is to provide an improved socket plate variable displacement compressor having a socket plate guide mechanism as set forth in the previous object wherein the guide rod includes a longitudinal, fluid flow passage operative to carry control fluid through the wobble plate chamber from the rear head section to the front cover section.

Further objects and advantages of the present invention will be apparent from the following description, reference being had to the accompanying drawings wherein a preferred embodiment of the present invention is clearly shown.

Figure 1:
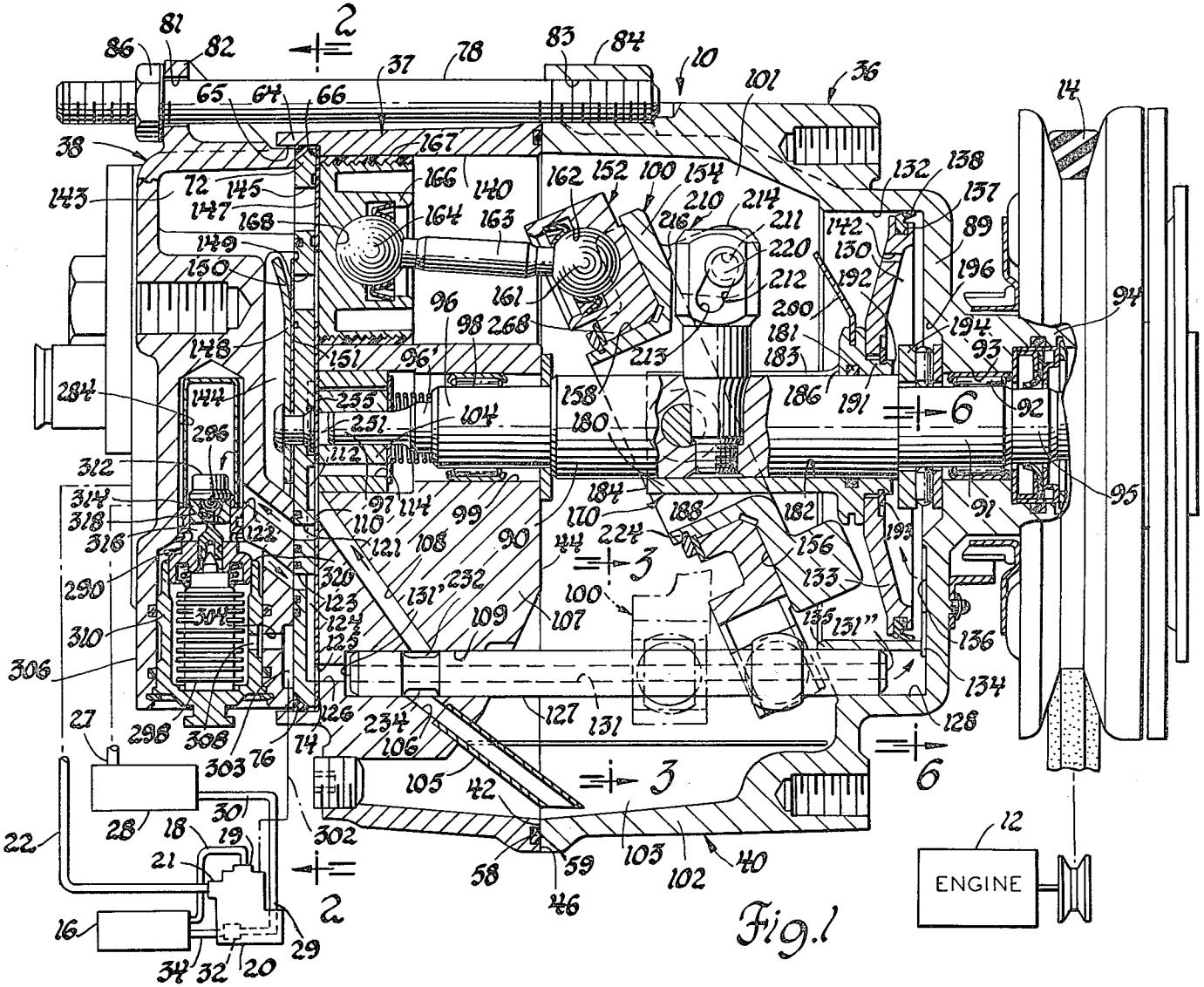
FIG. 1 is a vertical sectional view showing a preferred form of the compressor of the present invention including a cooling system schematic.

Referring now to the drawings, wherein a preferred embodiment of the present invention has been disclosed, reference numeral 10 in FIG. 1 designates a variable displacement axial compressor which is adapted to be driven by the main car engine 12 through suitable belt means 14 in a manner shown and described in the above-mentioned Brucken et al U.S. Pat. No. 4,105,370.

As shown schematically in FIG. 1, the refrigerating system includes the usual refrigerant evaporator 16 having an outlet line 18 leading to one inlet 19 of a receiver 20 and exits at 21 into line 22 leading to the compressor inlet (not shown). The compressed refrigerant leaves the compressor 10 through an outlet (not shown) into line 27 connected to a conventional condenser 28. The condensed refrigerant returns to a second inlet 29 of the receiver 20 by line 30 from whence the liquid refrigerant flows through a suitable pressure reducing means, which for the purposes of illustration has been shown as an expansion valve 32 in the receiver, and thereafter returns to the evaporator by line 34. The compressor 10 and condenser 28 are preferably located in the engine compartment of the car while the evaporator 16 is arranged in an enclosure so as to cool air for the passenger compartment of the car in the usual manner.

In the clutch starting and stopping system, described in the cited U.S. Pat. No. 4,061,443, the compressor's principle of operation involves reducing the refrigerant pressure drop between the evaporator 16 and compressor 28 by varying the compressor displacement to match the cooling requirement of the car. As a result, at moderate temperatures the compressor capacity is modulated to pump only the amount of refrigerant required to cool the car. Suction gas is delivered from the evaporator to the compressor at higher pressures and densities because, with the elimination of a suction throttling valve there is a reduction of line pressure drop. The fact that suction gas enters the compressor at a higher density, together with the reduction of mechanical or frictional losses, achieves a reduction in the compressor's power requirements.

As best seen in FIG. 1, the improved compressor 10 of the present invention includes a first shell-like cup-shaped front section 36, a mating second or intermediate cylinder casing section 37 and a third rear cylinder head section 38 adapted to be connected in series to form the compressor three-part housing assembly 40. The front shell section 36 has a rearwardly directed continuous peripheral edge 42. The second cylinder casing section 37 has a forwardly directed face 44 and co-planar peripheral edge 46 which when abutted against the front section edge 42 such that the first and second sections are in flush confronting engagement at a common transverse plane. The first and second sections are centered relative to one another by alignment means such as pins (not shown) The first 36 and second 37 sections are sealed to one another by elastomeric sealing ring 58 compressed in an annular groove 59 formed in the forwardly facing edge 46 of the second section 37.

The second intermediate cylinder section 37 has an integral extending peripheral flange portion 64, extending axially from circular internal shoulder 66, with the flange portion inner wall 65 being of straight cylindrical form for receiving or fitting over third rear head section 38 in a telescopic manner. Located between the second and third sections, on shoulder 66, is a valve plate 72 having concentric reed plate 74 interposed therebetween with the rear head section sealed to the second section by an elastomeric sealing ring 76.

Securing means are provided for removably attaching the rear head section 38 to the front shell-like section 36 by means of double-ended threaded bolts 78. In the disclosed form a plurality of bolts 78 extend through holes 81 in circumferentially spaced flanged ears 82 integral with said rear head section. The holes 81 are axially aligned with a plurality of circumferentially spaced threaded bores 83 located in outwardly extending bosses 84 integral with front portion 36. The bores 83 threadably receive one end of bolts 78 while nuts 86 are threaded on the bolts' other end so as to draw the first section 36 axially in one direction enabling the edge 42 to abut against the seal ring 58 and rear head 38 to contact seal ring means 76 for holding the housing sections in assembled relationship. The seal rings 58 and 76 are thus deformed into sealing engagement with their adjacent housing sections.

Compressor main drive shaft 90 has its forward bearing portion end 91 rotatably mounted or journaled on front needle bearings 92 in axial bore 93 formed in a protruding integral tubular extension 94 located on end cover portion 89 of the front section 36. The tubular extension 94 is coaxial with and surrounds the shaft intermediate end 95 in concentric fashion. The shaft 90 has rearward decreased diameter stepped portions 96 and 96' with portion 96 journaled on rearward needle bearing 98 in rear axial bore 99 of the housing intermediate casing section 37.

As viewed in FIG. 1, compressor wobble plate mechanism generally indicated at 100, is enclosed by cavity 101 formed in the shell-like housing front section 36. The wobble plate cavity 101 is provided with an integral distended bulge portion 102 forming an oil sump or crankcase region 103. The sump collects oil and refrigerant mixture by gravity flow thereto. The oil and refrigerant mixture in the sump is partially received from piston blow-by for circulation through the compressor by a fluid flow circuit which includes passage means providing a lubricating network for the compressor mechanism including its thrust and journal bearings. Hydraulic fluid pump means or assembly shown in the form of a gear pump 104, driven by reduced rearmost extension or end 97, providing a D-shaped quill. The pump 104 serves to withdraw hydraulic fluid in the form of an oil and refrigerant mixture from the sump 103 through pickup conduit or tube 105.

As seen in FIG. 1, the tube 105 upper end is telescoped into lower angled passage or bore 106 formed in the intermediate casing section cylinder portion or block 107. The passage 106 has its upper outlet end in communication with block upper angled passage 108 via an axial blind bore 109 in the cylinder block 107. The upper angled passage 108 outlet communicates via kidney shaped aperture 110 in reed valve disc 74 with a substantially mating kidney shaped depression 112, formed in the inner face of valve plate 72. The depression 112 upper portion is positioned in communication with inlet side 114 of the gear pump 104.

The gear pump outlet communicates with the upper portion of valve plate arcuate groove 116 via overlying valve disk arcuate slot 118. A downwardly curved tail portion 120 of the valve plate groove 116 terminates in valve plate exit orifice 121 in communication with fluid inlet passage 122 in the rear head section 38 communicating with a stepped rear head bore containing an hydraulic control valve to be described. The valve plate includes an inlet orifice 123 aligned with rear head outlet passage 124. The inlet orifice 123 communicates with a vertically extending valve plate groove 124' the lower end of which connects with reed disc hole 125 providing fluid flow into axial block passage 126. It will be noted that axial passage 126 is aligned on the principal axis of the cylinder block blind bore 109.

Figure 6:
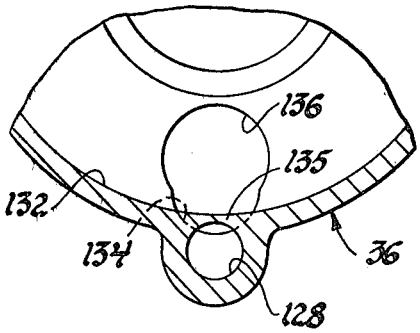
FIG. 6 is an enlarged fragmentary vertical elevational view, partly in section, taken substantially on the line 6—6 of FIG. 1.

A guide pin or rod 127 has its forward or first one end rigidly retained by a press fit within front end cover blind bore 128 and its rearward or second other end retained in a press fit manner within the axially aligned cylinder block blind bore 109. As seen in FIGS. 1 and 6 the blind bore 128 is in communication with expansible chamber 130 defined by axial blind bore 132 and piston means in the form of disc-shaped piston 133. In the disclosed form this fluid flow communication from blind bore 128 is provided by a slit 134 in the upper intermediate wall portion 135 and recessed portion 136 formed in the inner face of the end cover portion 89 of the front section 36.

Figure 3:
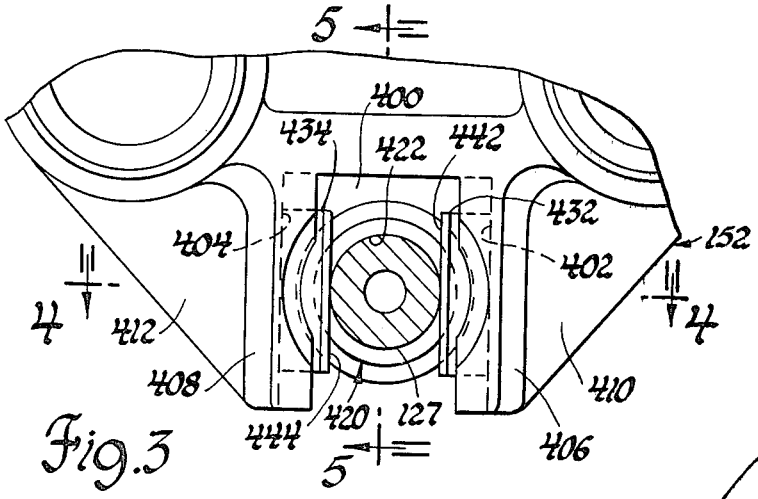
FIG. 3 is an enlarged fragmentary, vertical sectional view taken substantially on the line 3—3 of FIG. 1.

As seen in FIGS. 1 and 3 the guide rod 127 which extends through the wobble plate cavity 101 in a common plane with the drive shaft 90, includes longitudinally extending fluid passage means in the form of an axial through bore 131 including an inlet end 131' and an outlet end 131''.

The modulation piston 133 has a rectangular shaped peripheral edge groove 137 for reception of a resilient rim seal member 138 conforming to the walls of bore 132 providing sealed contact therewith. The compressor pressurized hydraulic fluid or lubricant is effectively sealed in the expansible chamber 130, except for controlled exit means, which in the disclosed form is a single bleed orifice 142 in modulating piston 133. In the disclosed form the bleed orifice 142 has a diameter of about 0.031 inches. In this way the unloading or outward flow of hydraulic fluid from the chamber 130 via orifice 142 for gravity return to the sump 103 is controlled upon the wobble plate mechanism moving toward its full stroke position as explained in the aforementioned Black et al application.

Cylinder block portion 107 of section 37 includes a plurality of piston bores one of which is shown at 140. The rear cylinder head section 38 for the cylinder bores 140 includes an outer suction or gas inlet chamber 143 and a center discharge or gas outlet chamber 144. As shown in FIG. 1, each compression chamber or piston bore 140 communicates with the suction chamber 143 through an inlet port such as the port 145 (FIG. 3). The inlet reed valve disc 74, having inlet reeds 147, controls the flow of refrigerant through the suction inlet ports 145 in accordance with standard practice. The compressed refrigerant leaves each compression bore 140 through a discharge port 149, while a reed valve 150, in a discharge reed valve disc 151, at each discharge port 149 is provided in accordance with standard practice. It will be noted in FIG. 1 that the extent of the opening of the reed valve 150 is limited by a rigid back-up plate member 148 suitably secured to the valve plate 72 as by a rivet.

For purposes of illustrating this invention, a variable displacement five cylinder axial compressor 10 will be described whereas it will be understood that the number of cylinders may be varied without departing from the spirit and scope of the invention. The wobble plate drive mechanism 100 includes a wobble or socket plate 152 and a journal element or drive plate 154. The drive plate 154 and socket plate 152 define a plane bearing surface 156 and an outer cylindrical journal surface 158 with the drive plate 154 rotating in unison with the shaft 90. The socket plate 152 has five sockets, one of the sockets being shown at 162, for receiving the spherical ends 161 of five connecting rods, like the connecting rods 163, as seen in FIG. 1. The free ends of each of the connecting rods 163 are provided with spherical portions 164 as shown. The plurality of axial cylinder bores 140 in cylindrical casing section 37, there being five in the preferred embodiment, receive pistons 166 therein. The pistons 166 are sealed by sleeves 167 which in the disclosed form are Teflon sleeves. Piston 166, shown in its top-dead-center position, has a socket-like formation 168 for engaging one end of the connecting rod spherical portion 164. The pistons 166 operate within their associated compression chambers or bores 140 whereby upon rotation of the drive shaft 90 and the drive or journal plate 154 will cause reciprocation of the pistons 166 within their bores 140.

Drive shaft 90 has a generally cylindrical sleeve 170 with the sleeve 180 surrounding or circumscribing the shaft in hydraulic sealing relation therewith by means of compressible sealing means such as O-ring seal 181 located in a groove in the inner surface 182 of the sleeve. The sleeve 180 has formed therein a longitudinal slot 183 extending from the sleeve inner or rearward face 184 substantially the full length of the sleeve and terminates in a U-shaped radiused portion 186 within the confines of the cylinder bore 132. It will be noted that the sleeve 180 has a flat face portion 188 located in 180° opposed relation to the slot 183. The member 170 includes an integral forwardly projecting hub 191 whose forward shoulder 192 is in rotatable abutting contact with thrust bearing 194. The thrust bearing 194 is located in concentric recess 196 formed in the cover 89 of the front section 36.

In the disclosed embodiment the modulating piston 133 is retained on the hub portion 191 by C-clip 193 whereby the sleeve member 170 rotates with the shaft while the piston 133 moves axially with the sleeve member 170 but does not rotate therewith. A return spring member 200, having a radiating leaf spring finger (not shown) is positioned by means of a C-shaped retainer. For a complete description of the spring reference may be had to the mentioned U.S. Pat. No. 4,105,370. The spring member 200 is operative upon the modulating piston 134 and sleeve member 170 being moved axially to the left from its position in FIG. 1 to a compressed position contacting a drive lug, indicated at 210, with the wobble or journal plate mechanism 100 being pivoted to a vertical or normal position relative to the shaft 90 as partially indicated by dash-dot lines. Thus, the spring finger member 200 functions to move the wobble plate mechanism 100 from its dead center or zero stroke position wherein the pistons 166 start pumping by biasing the modulating piston 133 toward its full stroke position.

As explained above, the modulating piston member 133 cooperates with the cylinder bore 132 to form the expansible chamber 130 the size of which is varied by virtue of pump 104 being permitted to supply hydraulic fluid or lubricant under pressure into the chamber 130. At high fluid pressures, the piston 133 and sleeve 180 will be shifted axially to the left. The chamber 130 is unloaded upon the piston 133 being moved to the right causing flow of hydraulic fluid from chamber 130 and return to the sump by means of bleed aperture 142.

The shaft 90 drive lug 210, which is disclosed and claimed in U.S. Pat. No. 4,175,915, filed Apr. 27, 1978 to Black et al, extends in a transverse or normal direction to the drive shaft axis. The lug 210 has formed therein a guide slot or cam track 212 which extends radially along the axis of the drive shaft. The journal plate 154 carries an ear-like member 214 projecting normal to the journal forward face 216 and has a through bore for receiving cam follower means in the form of a cross pin driving member 220. Reference may be had to the mentioned U.S. Pat. No. 4,061,443 for a complete description of the operation of the cam track arrangement.

It will be noted in the Black et al U.S. Pat. No. 4,061,443 that the radiused ends 211 and 213 of the cam track 212 define respectively, the maximum and minimum stroke lengths for each of the pistons 166 in a manner to constrain the socket plate mechanism 100 providing essentially constant top-dead-center (TDC) positions for each of the pistons. Cam follower means in the form of the pin follower 220 interconnects the socket plate mechanism 100 and the drive shaft 90 and is movable radially with respect to the lug 210 and the wobble plate mechanism 100 in response to the movement of the sleeve member 170, whereby the angle of the socket plate mechanism is varied with respect to the drive shaft 90 to infinitely vary the stroke lengths of the pistons 166 and thus the output of the compressor.

The fluid flow circuit for applicants' compressor, as indicated in part by short arrows in FIG. 1, traces fluid in the form of oil being drawn up from the compressor sump area 103 through the pick-up tube 105 and passage 106 for exiting into an annular cavity 232 defined by an intermediate portion of bore 109 coextensive with a reduced diameter portion 234 of the guide rod 127. The annular cavity 232 has its upper end in communication with passage 108. The oil exits passage 108 through the aperture 110 in the suction inlet reed disc 74 and thence into the valve plate inner face depression 112 and valve disc aperture 110 arranged directly over the inlet side 114 of the gear pump 104.

An internal flow path for the fluid flow circuit is established by oil under pressure being discharged from the pump outlet through a slot 255 in the reed disc 74 into region 251 at the rear of the shaft end portion 97 for flow through an axial bore (not shown) in shaft 90 for travel forwardly to a pair of transverse shaft bores aligned with plate pin bores (not shown) for flow between the journal or drive plate hub 224 and the socket plate hub 268 to lubricate the journal bearing surfaces 156 and 158 as shown in further detail in the U.S. Pat. No. 4,105,370 referred to above.

Figure 2:
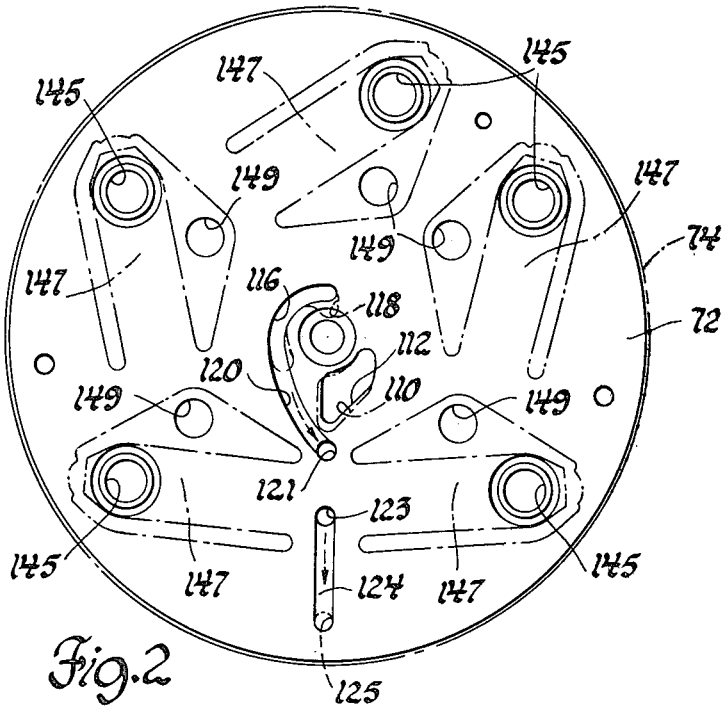
FIG. 2 is a vertical sectional view taken substantially on the line 2—2 of FIG. 1 showing the rear valve plate with its overlying reed valve indicated in phantom lines.
Figure 5:
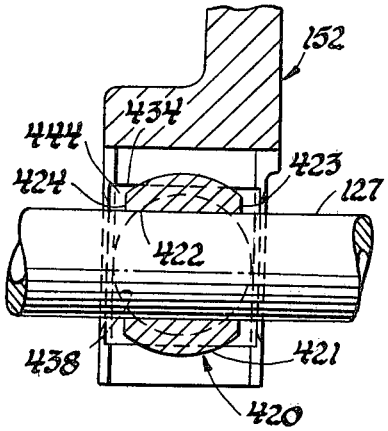
FIG. 5 is an enlarged fragmentary, vertical sectional view taken substantially on the line 5—5 of FIG. 3.

The modulation oil flow path, partially indicated by dashed arrows in FIG. 2, involves flow from the outlet of the pump 104 into the arcuate groove 116 portion 120, out valve plate orifice 121 into the head passage 122 for entrance into the blind end region of bore 284 of a hydraulic control valve generally indicated at 290 in FIG. 1. The valve 290 functions to control the amount of piston travel or stroke by means of ball valve member 296 controlled by valve bellows 298 which senses evaporator pressure from the evaporator control unit 20 via line 302, head cavity 303 passage 304 in the rear head section valve housing 306 and passage 308 in the valve casing 310.

Upon reaching the blind bore 284, the hydraulic control fluid or oil will flow through inlet 312 of valve stem 314, past the ball valve member 296, and thence into region 316 via axial stem bore 318 for exiting via exit bore 320. From exit bore 320 the oil returns to the compressor via rear head outlet passage 124 which communicates with valve plate inlet orifice 123 aligned for connection with the upper end of vertical outlet passage 124. The lower end of passage 124 communicates with cylinder block axial passage 126, which in turn connects with the front section radial passage 128 opening into the modulating inlet end 131' of the control rod longitudinal closure passage means in the form of axial through bore 131. As explained above, guide rod passage 131 is connected at its outlet end 131" and bore 128 with slit 134 and front section wall recessed portion 136 allowing the flow of oil into the modulation expansible chamber 130. For a detailed description of the hydraulic control valve reference may be had to U.S. Pat. No. 4,236,875, issued Dec. 2, 1980, assigned to the assignee of the present invention.

Referring now more specifically to the guide rod mechanism as shown in FIGS. 1 and 3–5, the socket plate 152 is prevented from rotating with the drive plate 154 and shaft while permitting angular movement thereof relative to the drive shaft 90 as follows. The socket plate is provided with a radially extending slot 400 of predetermined size so as to receive the guide rod 127 therethrough. It will be noted that the guide rod has its first or front end received in bore 128 and its second or rearward end received in blind bore 109 so as to extend longitudinally through the drive plate chamber or cavity 101 in a common plane with the drive shaft. During operation of the compressor the socket plate undergoes combined longitudinal and arcuate travel as a result of the journal or drive plate nutational movement.

Figure 4:
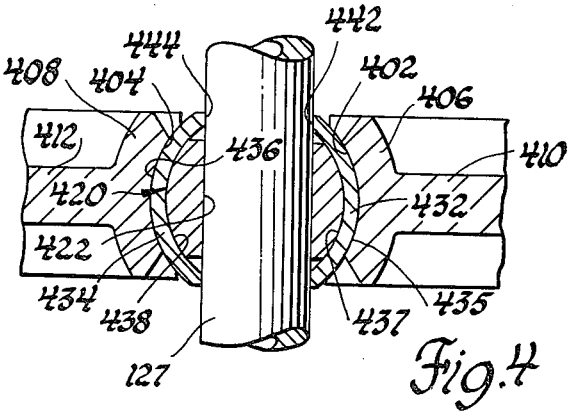
FIG. 4 is an enlarged fragmentary, sectional view taken substantially on the line 4—4 of FIG. 3.

As best seen in FIGS. 3 and 4, the slot 400 is formed with semicylindrical, radially extending guides 402 and 404. The guides are on opposing surfaces of depending arcuate ribs 406 and 408 shown integral with socket plate flanges 410 and 412, respectively. A bearing body, generally indicated at 420, has a central passage 422 through which the guide rod extends with the central passage 422 being defined by an inner surface which conforms to and slidably engages the outer surface of the guide rod.

The bearing body 420 is preferably in the form of a ball-type bearing providing a spherical portion 421 thereon with a central circular opening or passage 422 therethrough. Each end of the passage terminates in a pair of planar parallel faces 423 and 424. The inner diameter of the passage 422 is slightly greater than the outer diameter of the rod 127 to allow the bearing body to slide axially relative to the rod in a free manner.

A pair of semi-cylindrical shaped guide shoe members 432 and 434 are shown positioned in the socket plate slot 400 on opposite sides of the bearing body 420. Each of the shoe members is configured with a semi-cylindrical convex surface 435 and 436 conforming with its associated semi-cylindrical concave guide 402 and 404 respectively for radial sliding contact therewith.

Each of the guide shoe members has a concave semi-spherical surface or recess 437, 438 facing each other for receiving and relatively slidably retaining the bearing body spherical portion 421 therebetween. It will be observed in FIGS. 4 and 5 that each of the recesses 436 and 438 is formed in a planar surface 442 and 444 of its guide shoe members, respectively. Thus, each planar surface defines a planar portion substantially slidably bearing on the guide rod operative to maintain the guide shoe members in substantially parallel planes.

As a consequence of the above-described arrangement the guide shoes 432, 434 are free to reciprocate radially in their associated guides 402 and 404 and reciprocate longitudinally along the rod 127 together with the bearing body 420 retained by the guide shoe members during operation of the journal plate 154 in response to rotation of the shaft 90.

While the embodiment of the present invention as herein disclosed constitutes a preferred form, it is to be understood that other forms might be adopted.

The embodiments of the invention in which an exclusive property or privilege is claimed are defined as follows:

1. In a variable stroke wobble plate type compressor having a cylinder block, a drive shaft rotatable in said cylinder block a plurality of cylinder bores in said block substantially parallel to the axis of said shaft, pistons arranged to reciprocate in said cylinder bores, a journal plate operated in response to rotation of said drive shaft and drivingly connected to said pistons, the connection of said journal plate to said pistons including a socket (wobble) plate is relatively slidable interface relation with said journal plate, and means for varying the angle of the journal plate relative to said drive shaft and thus the stroke of the pistons in their bores, the improvement comprising a longitudinally extending guide rod supported in a common plane with said drive shaft, said socket plate provided with a radially extending slot of predetermined size receiving said guide rod therethrough for longitudinal and arcuate travel of said socket plate along said rod as a result of said journal plate movement, said slot having semi-cylindrical radially extending guides on opposing surfaces thereof, a bearing body having a central passage through which said rod extends with said central passage being defined by an inner surface which conforms to and slidably engages the outer surface of said rod, said bearing body having a convex spherical portion thereon, a pair of semi-cylindrical shaped guide shoe members positioned in said slot on opposite sides of said bearing body, each of said guide shoe members configured to conform with its associated guide for radial sliding contact therewith spread over a substantial area, each of said guide shoe members having a concave semi-spherical recess facing each other for receiving and relatively slidably retaining said bearing body convex spherical portion therebetween for relative swiveling movement with a substantial contact area, each of said guide shoe members at each end of said concave semi-spherical recess having a portion substantially slidably bearing on said guide rod to maintain the guide shoe members in substantially parallel planes, whereby said guide shoe members reciprocate radially in their associated guides and reciprocate longitudinally along said rod together with said bearing body retained by said guide shoe members in relative swiveling relationship during the operation of said journal plate in response to rotation of said drive shaft.

2. A variable output compressor having a housing including an end cover and a cylinder block defining a cavity therebetween including a lower crankcase portion; said cylinder block having a head thereon, a drive shaft having its one end journaled in said end cover and its other end journaled in said cylinder block, a plurality of cylinder bores formed in said block substantially parallel to the axis of said shaft, pistons arranged to reciprocate in said cylinder bores, a journal plate in said cavity operated in response to rotation of said shaft and drivingly connected to said pistons, the connection of said journal plate to said pistons including a socket plate in relatively slidable interface relation with said journal plate, compressor output modulation means for varying the angle of inclination of said journal plate relative to said drive shaft and thus the stroke of said pistons, said modulation means including an expansible fluid chamber including an axially movable member, pump means driven by said shaft, a fluid circuit in said compressor for conducting fluid from said cavity crankcase portion to the inlet of said pump means and from the outlet of said pump means to said expansible chamber via control means in said head for effecting movement of said axially movable member and the resultant angle of inclination of said journal plate, the improvement comprising a longitudinally extending guide rod having its first and second ends received, respectively in opposed bores formed in said end cover and said cylinder block, wherein said guide rod extends through said cavity in a common plane with said drive shaft, a bearing body having a central passage through which said guide rod extends with said central passage defined by an inner surface which conforms to and slidably engages the outer surface of said rod, guide means interconnecting said socket plate with said bearing body permitting said guide means to reciprocate radially relative to said socket plate and reciprocate longitudinally along said rod together with said bearing body during the operation of said journal plate in response to rotation of said drive shaft, fluid passage means extending longitudinally through said guide rod including an inlet and an outlet, said control circuit including passage means in said compressor interconnecting said guide rod passage means inlet with the outlet of said control means and said guide rod passage means outlet with said expansible chamber, whereby said guide rod passage means being operative in said circuit for conducting fluid from said control means to said expansible chamber for causing the travel of said axially movable member to thus regulate the inclination of said journal plate and the pumping capacity of said compressor.

3. In a variable stroke wobble plate type compressor having a cylinder block, a drive shaft rotatable in said cylinder block, a plurality of cylinder bores in said block substantially parallel to the axis of said shaft, pistons arranged to reciprocate in said cylinder bores, a journal plate operated in response to rotation of said drive shaft and drivingly connected to said pistons, the connection of said journal plate to said pistons including a socket (wobble) plate in relatively slidable interface relation with said journal plate, and means for varying the angle of the journal plate relative to said drive shaft and thus the stroke of the pistons in their bores, the improvement comprising a longitudinally extending guide rod supported in a common plane with said drive shaft, said socket plate provided with a radially extending slot of predetermined size receiving said guide rod therethrough for longitudinal and arcuate travel of said socket plate along said rod as a result of said journal plate movement, said slot having radially extending guides on opposing surfaces thereof, a bearing body having a central passage through which said rod extends with said central passage being defined by an inner surface which conforms to and slidably engages the outer surface of said rod, said bearing body having a convex spherical portion thereon, a pair of guide shoe members positioned in said slot on opposite sides of said bearing body, each of said guide shoe members configured to conform with its associated guide for radial sliding contact therewith spread over a substantial area, each of said guide shoe members having a concave semi-spherical recess facing each other for receiving and relatively slidably retaining said bearing body convex spherical portion therebetween for relative swiveling movement with a substantial contact area, each of said guide shoe members at each end of said concave semi-spherical recess having a portion substantially slidably bearing on said guide rod to maintain the guide shoe members in substantially parallel planes, whereby said guide shoe members reciprocate radially in their associated guides and reciprocate longitudinally along said rod together with said bearing body retained by said guide shoe members in relative swiveling relationship during the operation of said journal plate in response to rotation of said drive shaft.

* * * * *

UNITED STATES PATENT AND TRADEMARK OFFICE

CERTIFICATE OF CORRECTION

PATENT NO. : 4,297,085

DATED : October 27, 1981

INVENTOR(S) : Byron L. Brucken

It is certified that error appears in the above—identified patent and that said Letters Patent is hereby corrected as shown below:

Column 8, line 15, "is" should read -- in --.

Signed and Sealed this

*Thirty-first* Day of *August 1982*

[SEAL]

*Attest:*

GERALD J. MOSSINGHOFF

*Attesting Officer* *Commissioner of Patents and Trademarks*